US007691030B2

(12) United States Patent
Hsiao

(10) Patent No.: US 7,691,030 B2
(45) Date of Patent: Apr. 6, 2010

(54) SHOCK-ABSORBING DEVICE FOR AN EXERCYCLE DYNAMO

(76) Inventor: Chi-Chang Hsiao, 4F., No. 251, ShengLi RD., Tanzih Township, Taichung Hsien 42750 (TW)

( * ) Notice: Subject to any disclaimer, the term of this patent is extended or adjusted under 35 U.S.C. 154(b) by 0 days.

(21) Appl. No.: 12/509,469

(22) Filed: Jul. 26, 2009

(65) Prior Publication Data

US 2010/0022353 A1 Jan. 28, 2010

Related U.S. Application Data

(63) Continuation-in-part of application No. 12/178,712, filed on Jul. 24, 2008, now abandoned.

(51) Int. Cl.
*A63B 71/00* (2006.01)

(52) U.S. Cl. ..... 482/2; 482/1; 482/51

(58) Field of Classification Search ..... 482/1–9, 482/51, 148, 55–57
See application file for complete search history.

(56) References Cited

U.S. PATENT DOCUMENTS

2009/0036275 A1* 2/2009 Hsiao ..... 482/63

* cited by examiner

*Primary Examiner*—Lori Baker
(74) *Attorney, Agent, or Firm*—Banger Shia

(57) ABSTRACT

A shock-absorbing device for an exercycle dynamo comprises a bracket and a dynamo. The dynamo generates electricity for the exercycle, and the bracket is connected to the dynamo and the exercycle by plural elastic members, which can provide different shock-absorbing and buffering effects on different positions of the bracket. By such arrangements, better shock-absorbing and buffering effect can be provided to the dynamo.

10 Claims, 11 Drawing Sheets

SHOCK-ABSORBING DEVICE FOR AN EXERCYCLE DYNAMO

BACKGROUND OF THE INVENTION

This application is a continuation of part of U.S. patent application Ser. No. 12/178,712, which claims the benefit of the earlier filing date of Jul. 24, 2008 now abandoned. Claims 1-2 of this application are revised from the previous claims 1-5 of the U.S. patent application Ser. No. 12/178,712, claims 3-10 of this application correspond to the previous claims 6-12 of the U.S. patent application Ser. No. 12/178,712.

1. Field of the Invention

The present invention relates to an exercycle, and more particularly to a shock-absorbing device for an exercycle dynamo.

2. Description of the Prior Art

Common exercisers (for example, exercycles) are mostly each provided with a display screen for displaying the amount of exercise or cooperating with an operation panel to increase additional functions. However, the display screen needs to consume electric energy from external power supplies or in-built batteries, in other words, extra electrical energy.

In order to solve the above problems, exercisers which are each interiorly equipped with a dynamo have been developed on the market. During exercise, such an exerciser can actuate the internal dynamo to generate electric energy and supply the electric energy to its display screen, thus achieving the objective of energy conversation.

However, in the above exerciser, the dynamo is directly fixed on the exerciser, so that the force and impact produced by exercise will be transferred to the dynamo. Because no buffer structure is arranged between the dynamo and the exerciser, after a long time of use, it is likely to cause damage to the dynamo or a fixing structure between the dynamo and the exerciser.

The present invention has arisen to mitigate and/or obviate the afore-described disadvantages.

SUMMARY OF THE INVENTION

The primary objective of the present invention is to provide a shock-absorbing device for an exercycle dynamo comprising a dynamo and an exercycle that are connected to a bracket through plural elastic members. The first elastic members are arranged on the bracket to provide the buffering and shock-absorbing function between the bracket, the dynamo and the exercycle. Each of the second elastic members and the third elastic members includes a screw at each of two ends thereof for screw connection, and the screws at both ends of each of the second elastic members and the third elastic members are not in contact with each other in such a manner that the shock acting on the screws at both ends of each of the second elastic members and the third elastic members can be absorbed by the elastic members. The elastic members arranged on different positions of the bracket can provide different buffering and shock-absorbing effects.

The bracket is only provided with the first elastic members to space the dynamo apart from the exercycle, or connected to the dynamo and the exercycle by plural additional second elastic members and third elastic members each of which includes a screw at each of two ends thereof for screw connection.

During exercise, the dynamo can be actuated to generate electricity for the exercyle. The first elastic members are provided for spacing the dynamo apart from the bracket and the third elastic member are used to connect the dynamo with the bracket. Since the bracket is connected to the exercycle via the second elastic members, more than two times of shock-absorbing and buffering effects are provided to the dynamo with respect to the exercyle, thus offering the optimal shock-absorbing and buffering effect, reducing the damage to the dynamo due to shock.

DETAILED DESCRIPTION OF THE PREFERRED EMBODIMENTS

Figure 1:
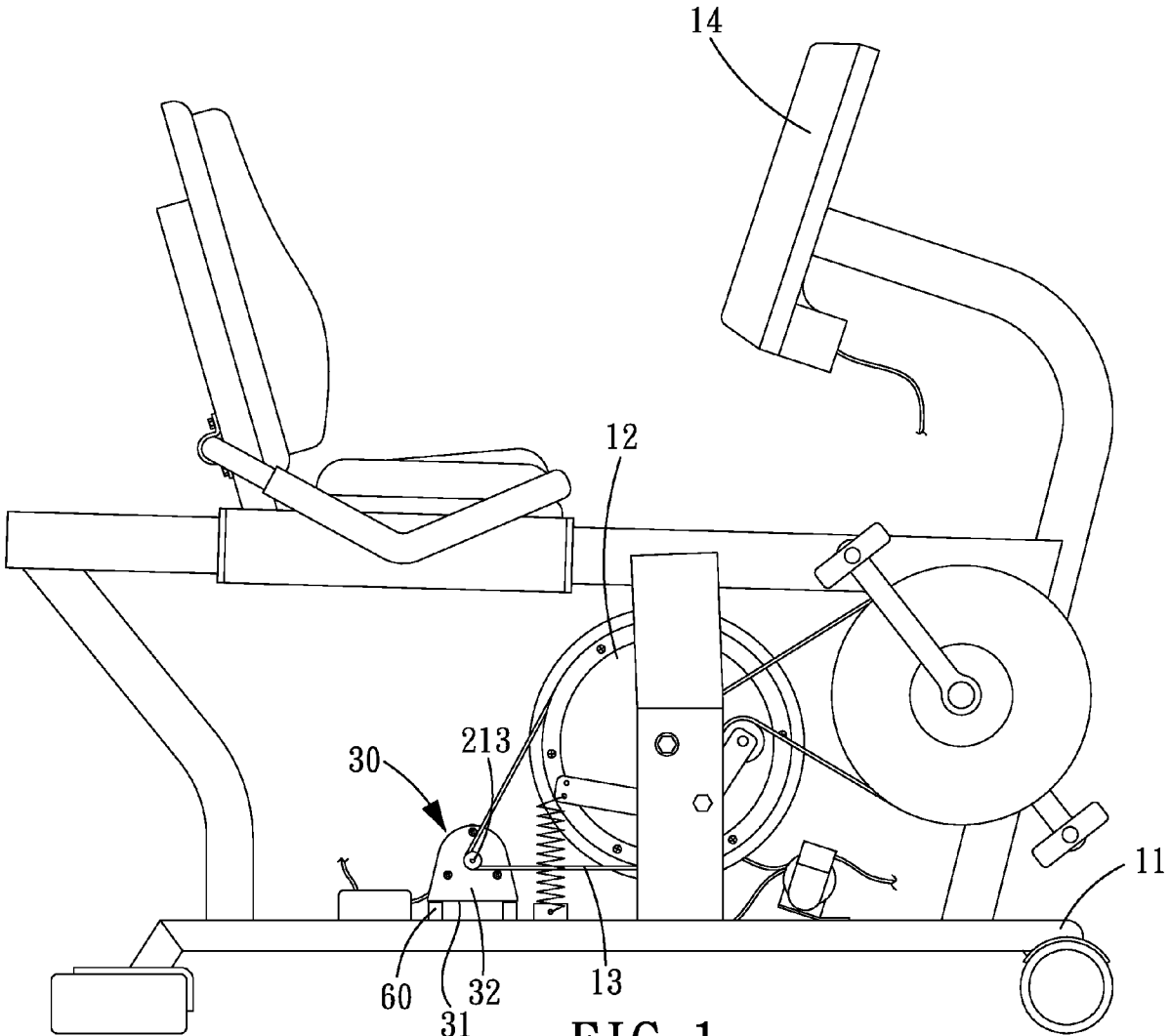
FIG. 1 is a schematic view showing that a shock-absorbing device for an exercycle dynamo in accordance with the present invention is disposed on an exercycle.

The present invention will be clearer from the following description when viewed together with the accompanying drawings, which show, for purpose of illustrations only, the preferred embodiment in accordance with the present invention.

FIGS. 1-4 show a shock-absorbing device for an exercycle dynamo in accordance with a preferred embodiment of the present invention. The exercycle comprises a base frame 11, a driving wheel 12 rotatably disposed on the base frame 11, a dynamo 20 disposed on the base frame 11 and including a rotor 21 and a stator 22, and a belt 13 straddling on the driving wheel 12 and the rotor 21. The shock-absorbing device in accordance with the present invention comprises a bracket 30, plural first elastic members 40, plural second elastic members 50, and plural third elastic members 60.

The dynamo 20 includes the rotor 21 and the stator 22. The stator 22 includes a magnet holder 221 which is defined with a center axle hole 221*a* and provided with a plurality of radial magnetic poles 222. An elastic cushion 223 and an axle bearing 224 are arranged in each of two ends of the axle hole 221*a* of the magnet holder 221. The respective elastic cushions 223 are located between the magnet holder 221 and the respective bearings 224. A plurality of windings 225 is wound on the respective magnetic poles 222 and shows a rhombic end-face profile. One side of the magnet holder 221 of the stator 22 is screwed to one end of a plurality of mounting plates 227 by means of screws 226. The rotor 21 includes a wheel 211 having a wheel axle 211*a*, and a plurality of magnets 212. The wheel axle 211*a* is inserted through the two bearings 224 and the axle hole 221*a* of the magnet holder 221. The wheel axle 211*a* is fixed with a belt pulley 213 around which a belt 13 is wound. The magnets 212 are arranged opposite to the magnetic poles 222 of the stator 22. Further, the wheel 211 is defined in one side thereof with a plurality of air holes 211*b* for quick dissipation of heat during operation of the dynamo 20.

The bracket 30 includes a base plate 31 integral with a side plate 32. The base plate 31 and the side plate 32 are respectively defined with plural mounting holes 311, 321. The respective mounting holes 311, 321 are provided with plural elastic members opposite to the dynamo 20 and the base frame 11. The number, position and structure of the respective elastic members changes to offer different shock-absorbing effects, so as to achieve the optimal shock-absorbing effect.

Each of the first elastic members 40 is in the form of a cylinder and defined with an axial through hole 41. Each of two opposite ends of the respective first elastic members 40 extends to form a radial stop flange 42. The middle portions of the first elastic members 40 are accommodated in the respective mounting holes 311, 321 of the base plate 31 and the side plate 32 of the bracket 30, and the two stop flanges 42 of each of the first elastic members 40 abut against the hole edges at both ends of the respective mounting holes 311, 321, respectively, that is to say, the two stop flanges 42 of each of the first elastic members 40 clamp both sides of the base plate 31 or the side plate 32, so that the first elastic members 40 are positioned in the respective mounting holes 311, 321 to offer the first shock-absorbing function.

Each of the second elastic members 50 is in the form of a cylinder and provided with a screw 51, 52 at each of two opposite ends thereof. Each of the screws 51, 52 includes a head portion 511, 521 and a body portion 512, 522. The head portions 511, 521 of the screws 51, 52 at both ends of the respective second elastic members 50 are disposed in the respective second elastic members 50 without contacting each other. The body portions 512, 522 of the two screws 51, 52 at both ends of the respective second elastic members 50 extend out of the respective second elastic members 50. The body portion 512 of the screw 51 of each of the second elastic members 50 is inserted through the through hole 41 of each of the first elastic members 40 disposed on the side plate 32 and screwed with a nut 53. The body portion 522 of the screw 52 of each of the second elastic members 50 is screwed into a threaded hole 227*a* of the respective mounting plates 227 so as to be fixed to the stator 22 of the dynamo 20.

Each of the third elastic members 60 is in the form of a cylinder and provided with a screw 61, 62 at each of two opposite ends thereof. Each of the screws 61, 62 includes a head portion 611, 621 and a body portion 612, 622. The head portions 611, 621 of the screws 61, 62 at both ends of the respective third elastic members 60 are disposed in the respective third elastic members 60 without contacting each other. The body portions 612, 622 of the two screws 61, 62 at both ends of the respective third elastic members 60 extend out of the respective third elastic members 60. The body portion 612 of the screw 61 of each of the third elastic members 60 is inserted through the through hole 41 of each of the first elastic members 40 disposed on the base plate 31 and screwed with a nut 63. The body portion 622 of the screw 62 of each of the third elastic members 60 is screwed to the base frame 11. The base frame 11 is defined with plural threaded holes 111, so that the body portions 622 of the screws 62 can be screwed to the base frame 11.

The aforementioned is the summary of the positional and structural relationship of the respective components of the preferred embodiment in accordance with the present invention.

For a better understanding of the present invention, its operation and function, reference should be made to the following description:

During exercise, the driving wheel 12 will be driven to pivot to drive the belt 13, and then the belt 13 will drive the belt pulley 213 of the rotor 21 of the dynamo 20 to make the rotor 21 pivot. The magnetic lines of force of the magnets 212 will work on the windings 225 at the magnetic poles 222 of the stator 22 to generate electricity during pivoting of the rotor 21. The electricity generated by the windings 225 of the stator 22 will be supplied to the display screen 14 of the exercycle. Further, the rhombic end-face profile of the magnetic poles 222 of the stator 22 enables the magnetic lines of force of the magnets 212 of the rotor 21 to work on the magnetic poles 222 obliquely, and therefore the rotor 21 can be pivoted more smoothly with less resistance.

Figure 2:
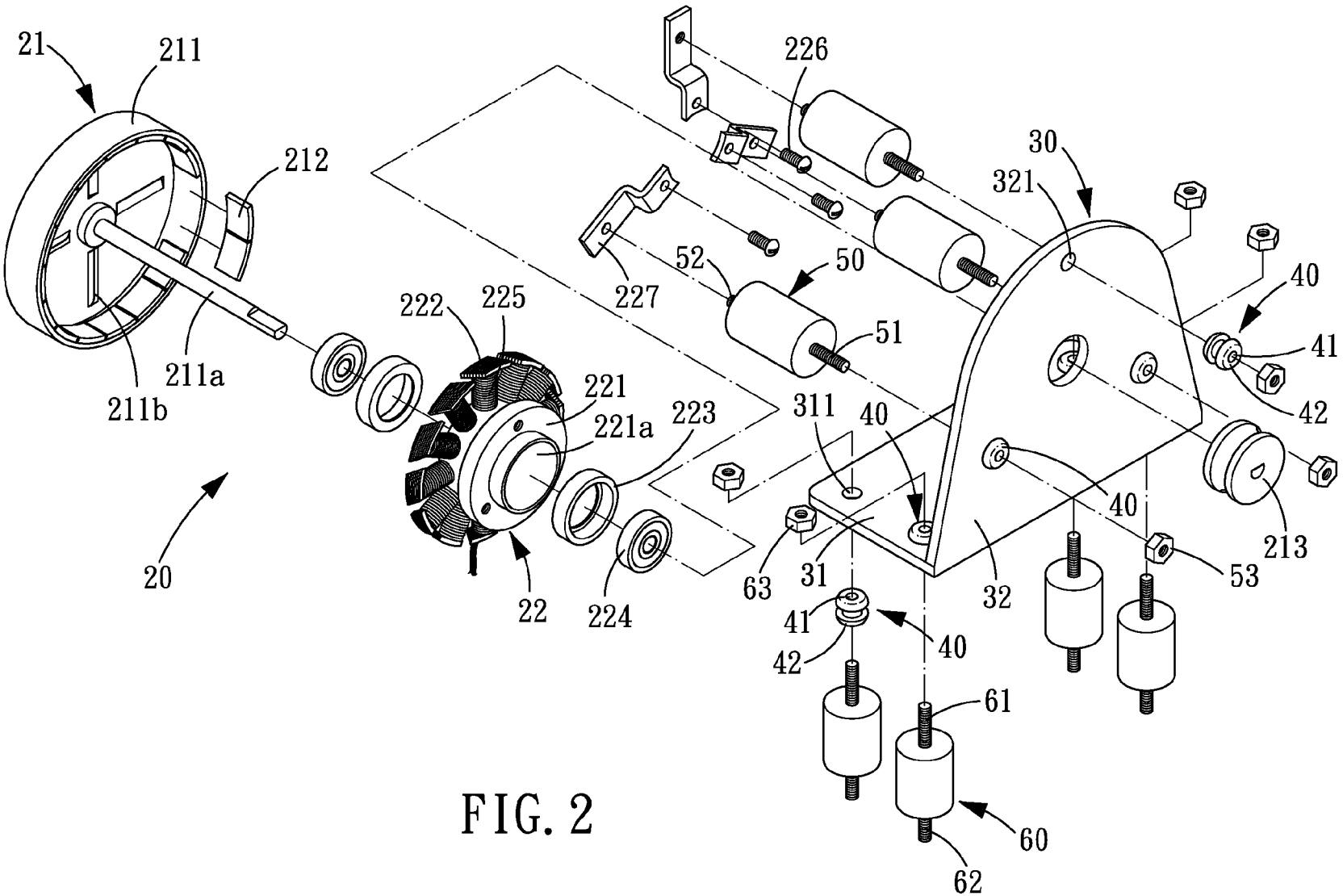
FIG. 2 is an exploded view of the shock-absorbing device for an exercycle dynamo in accordance with the present invention.
Figure 3:
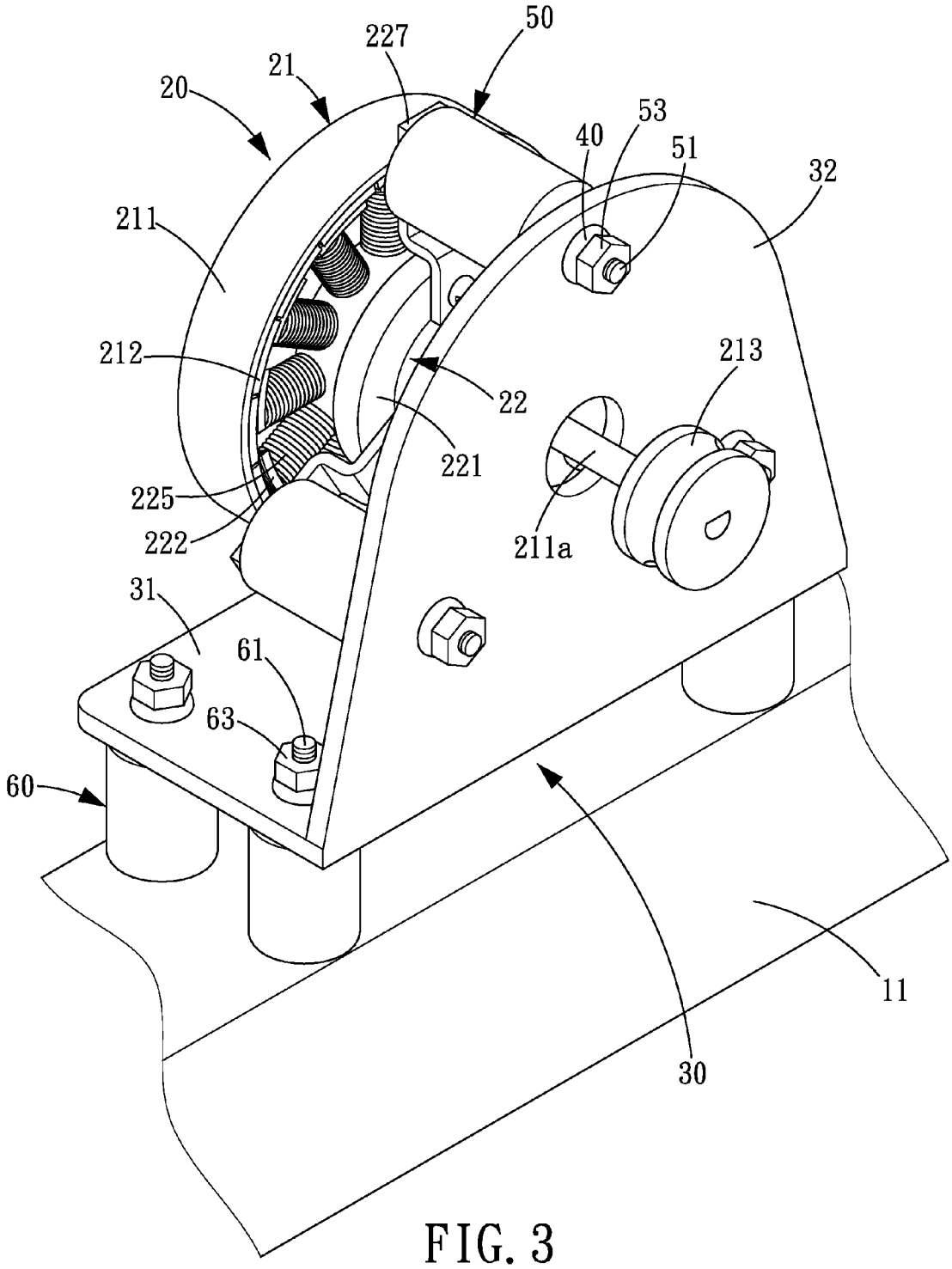
FIG. 3 is an assembly view of the shock-absorbing device for an exercycle dynamo in accordance with the present invention.
Figure 4:
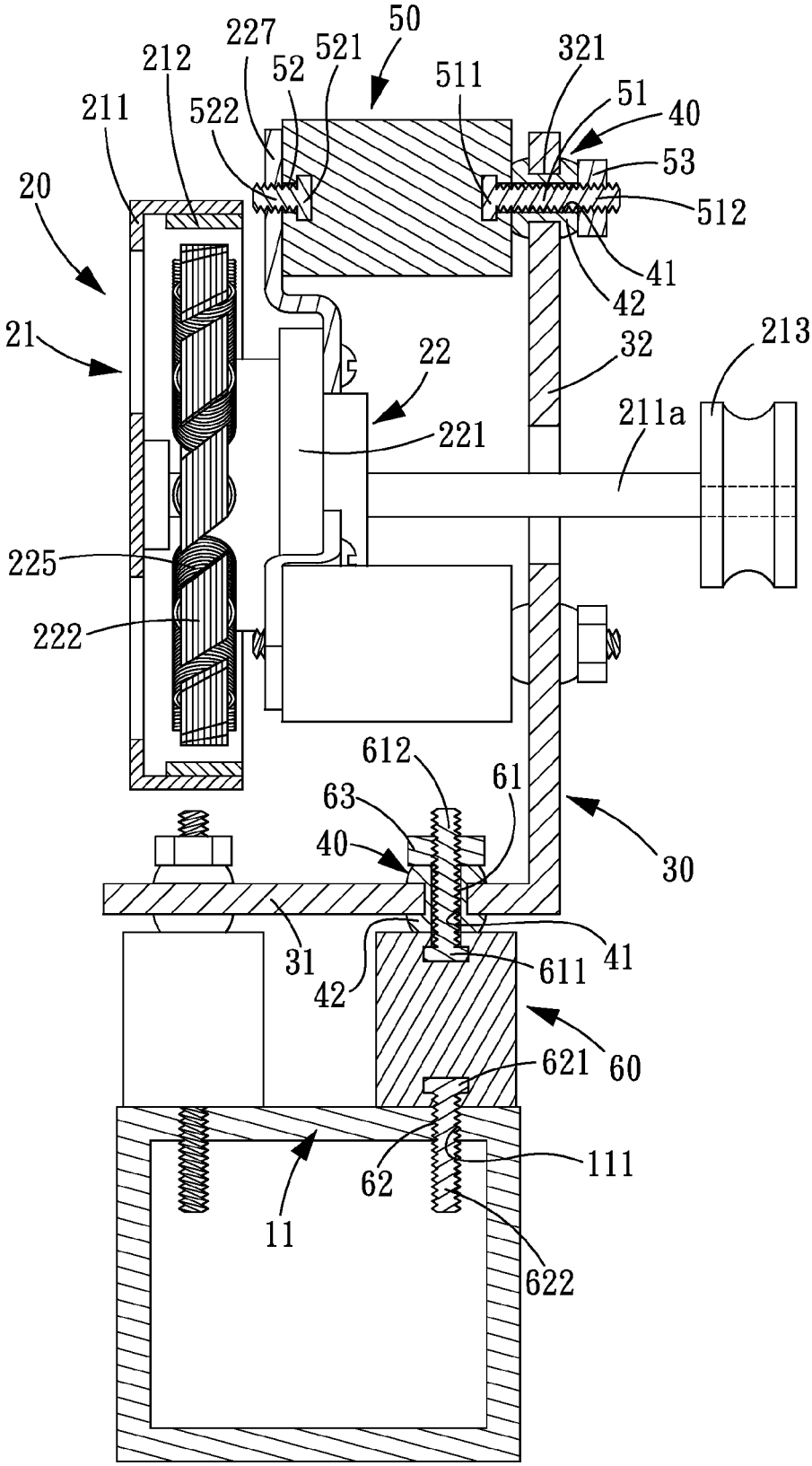
FIG. 4 is a cross-sectional view of the shock-absorbing device for an exercycle dynamo in accordance with the present invention.
Figure 5:
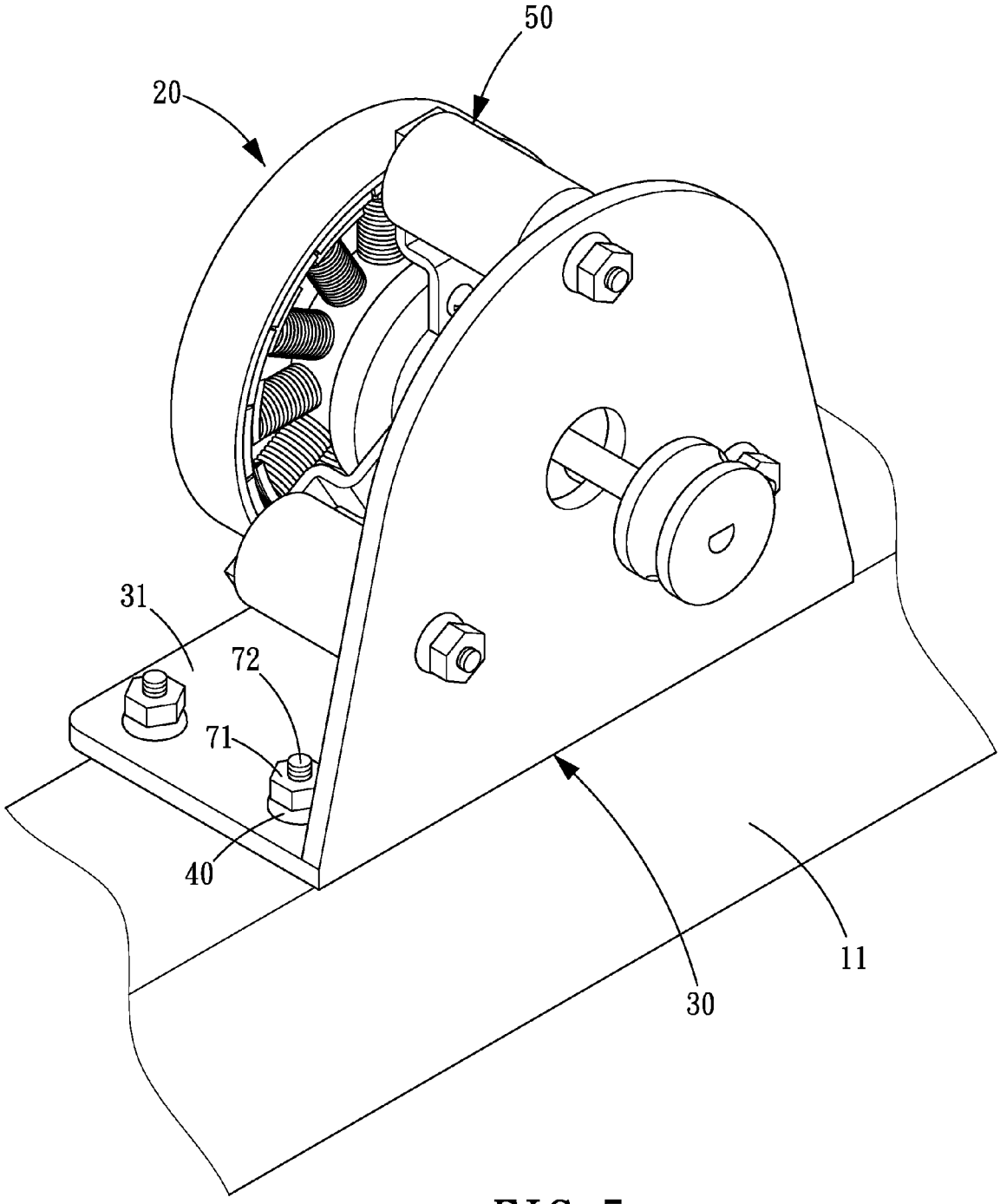
FIG. 5 is a perspective view showing that a bracket is provided with second elastic members opposite to the dynamo, and provided with first elastic members opposite to a base frame.
Figure 6:
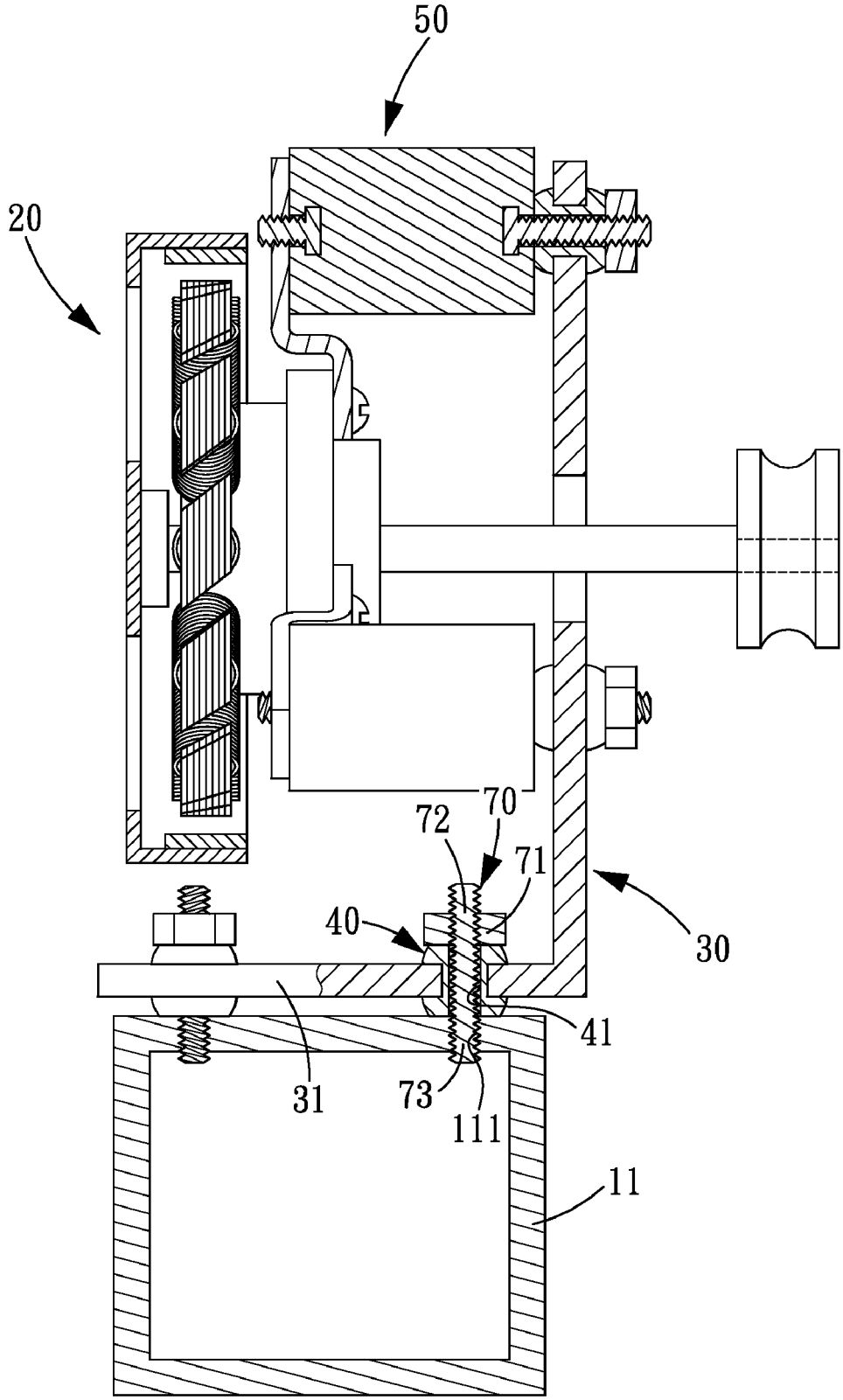
FIG. 6 is a cross-sectional view showing that the bracket is provided with the second elastic members opposite to the dynamo, and provided with the first elastic members opposite to the base frame.

The second elastic members 50 are arranged between the bracket 30 and the stator 22 of the dynamo 20, and the third elastic members 60 are arranged between the base frame 11 and the bracket 30. The first elastic members 40 can be respectively prearranged on a position of the bracket 30, on which the second elastic members 50 and the third elastic members 60 will be then provided. Therefore, between the base frame 11 and the rotor 21 are provided two kinds of members having the buffering and shock-absorbing function, so that the transmission of force and impact from the base frame 11 to the dynamo 20 can be greatly lessened, thus achieving the double buffering and shock-absorbing effect and avoiding the damage to the bracket 30 due to shock. The position, number and the cooperating configuration of the elastic members that are arranged on the bracket 30 can be varied as desired. As shown in FIGS. 2-4, the bracket 30 can be provided with the first elastic members 40 first and then provided with the second elastic members 50 and the third elastic members 60. Alternatively, as shown in FIGS. 5 and 6, the bracket 30 can also be provided with the second elastic members 50 on a position thereof opposite to the dynamo 20, and provided with the first elastic members 40 on a position thereof opposite to the base frame 11 to be directly connected to the base frame 11 by means of fixing members 70 (such as screws) cooperating with nuts 71, that is to say, one end 72 of each of the fixing members 70 is inserted through the through hole 41 of each of the first elastic members 40 disposed on the base plate 31 and screwed with each of the nuts 71, and the other end 73 of each of the fixing members 70 is screwed into each of the threaded holes 111 of base frame 11, thus providing different elastic buffering effects on the above two positions to achieve the above functions.

Figure 7:
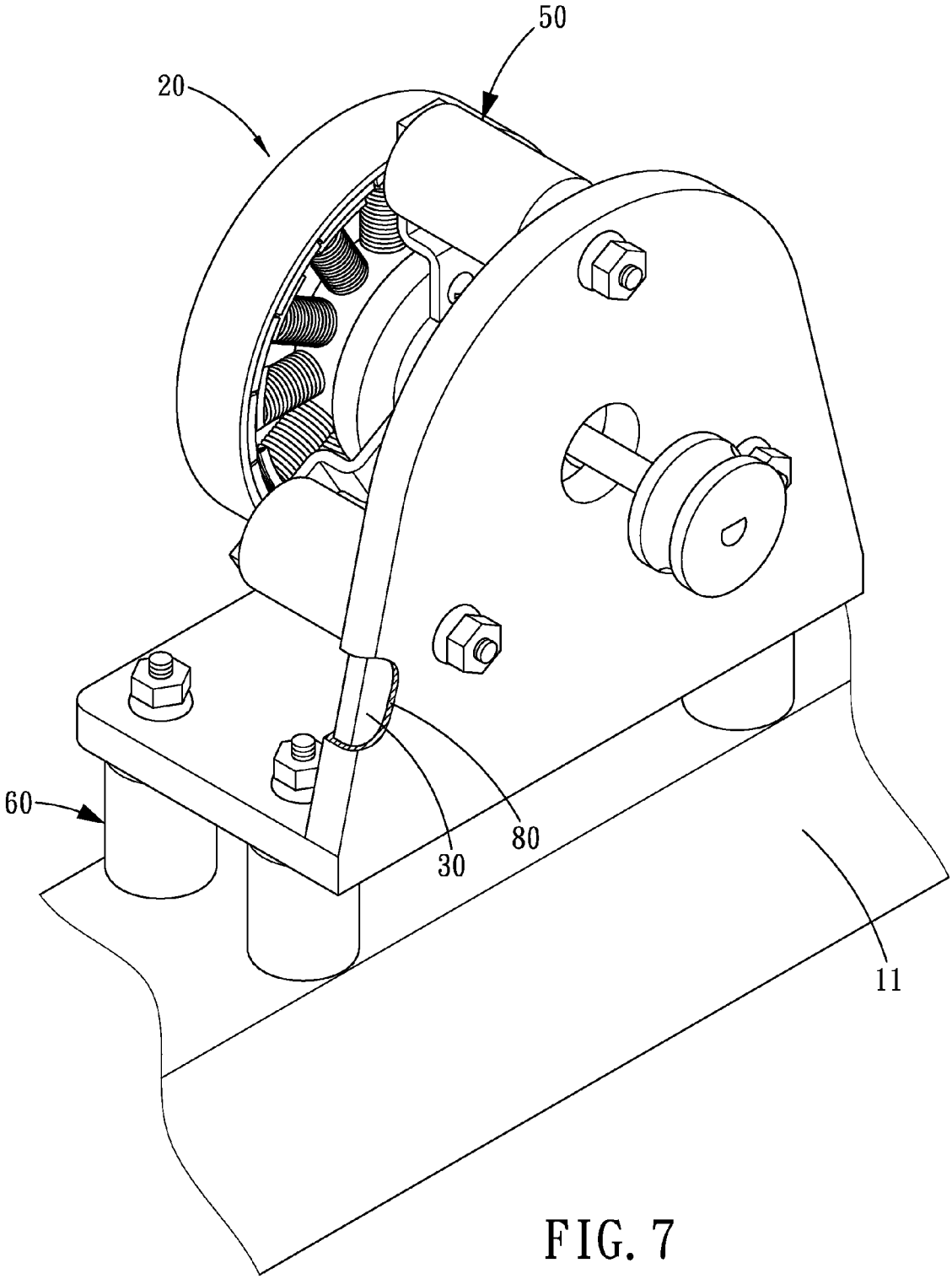
FIG. 7 is a schematic view showing that the bracket is covered with a layer of elastic rubber covering in accordance with the present invention.

In addition, as shown in FIG. 7, the bracket 30 can be covered with a layer of elastic rubber covering 80 to further enhance the buffering and shock-absorbing effect.

Figure 8:
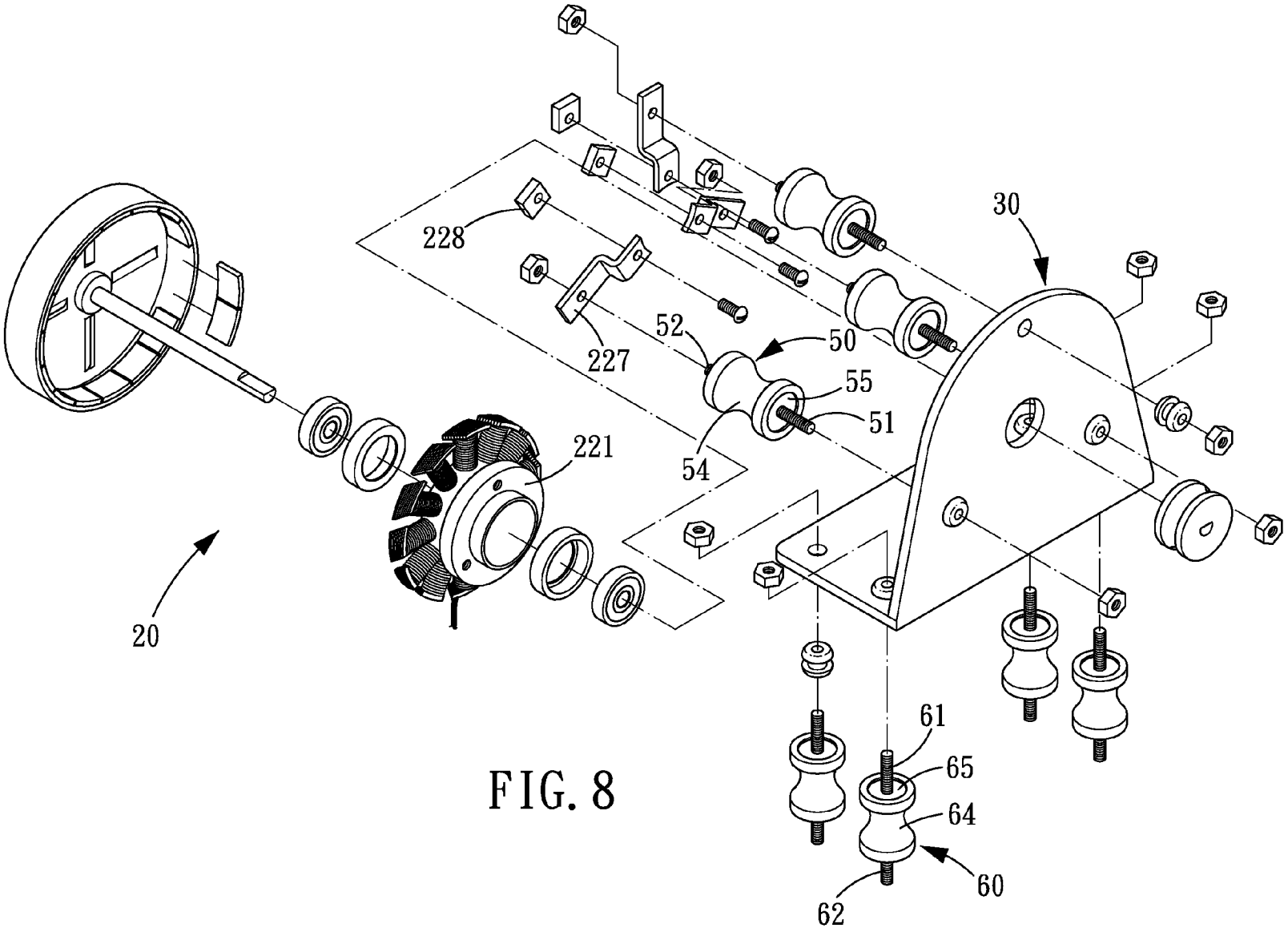
FIG. 8 is an exploded view illustrating that the second elastic members in accordance with the present invention are each formed with a concave portion.
Figure 9:
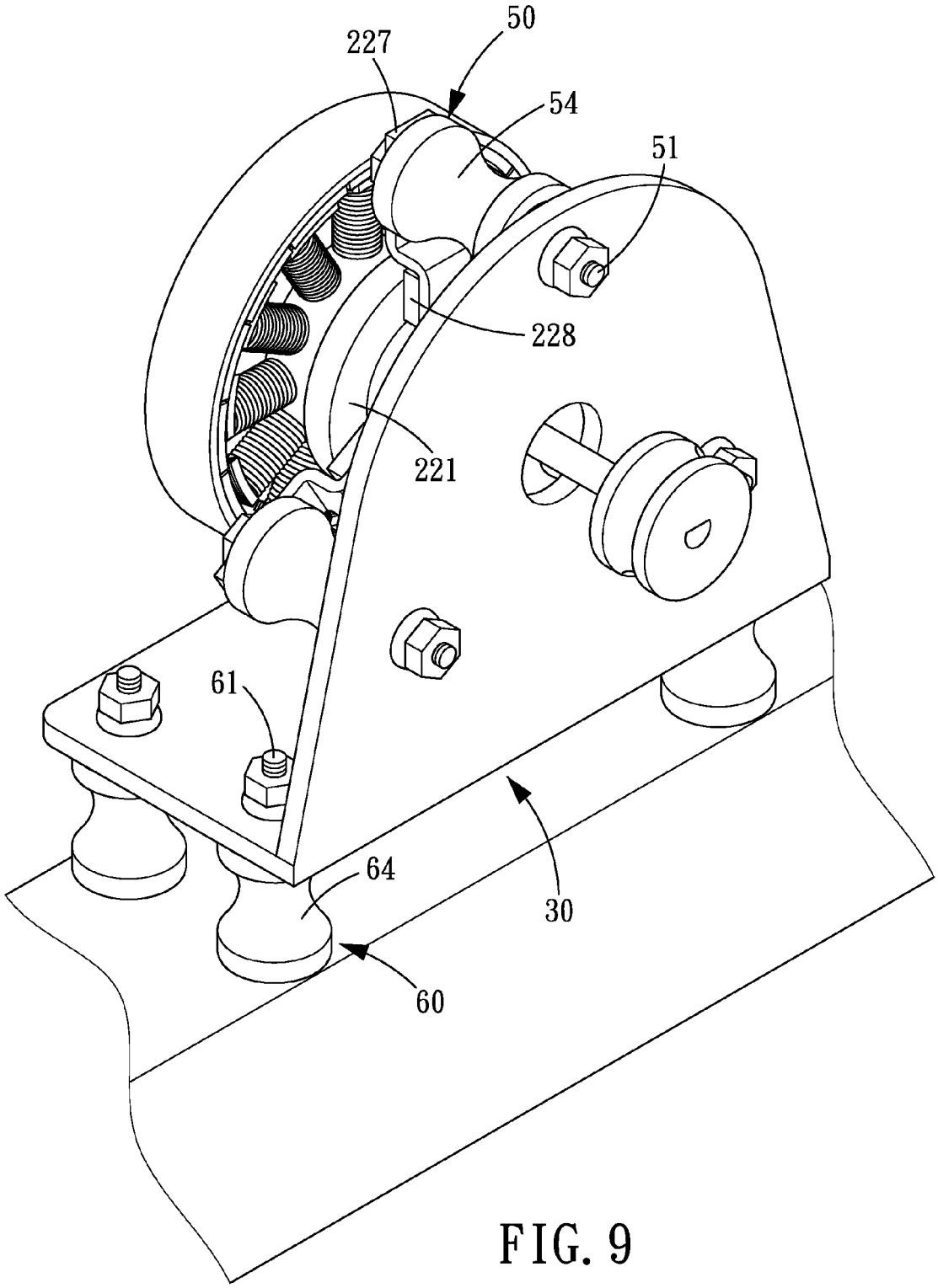
FIG. 9 is a perspective view illustrating that the second elastic members in accordance with the present invention are each formed with the concave portion.
Figure 10:
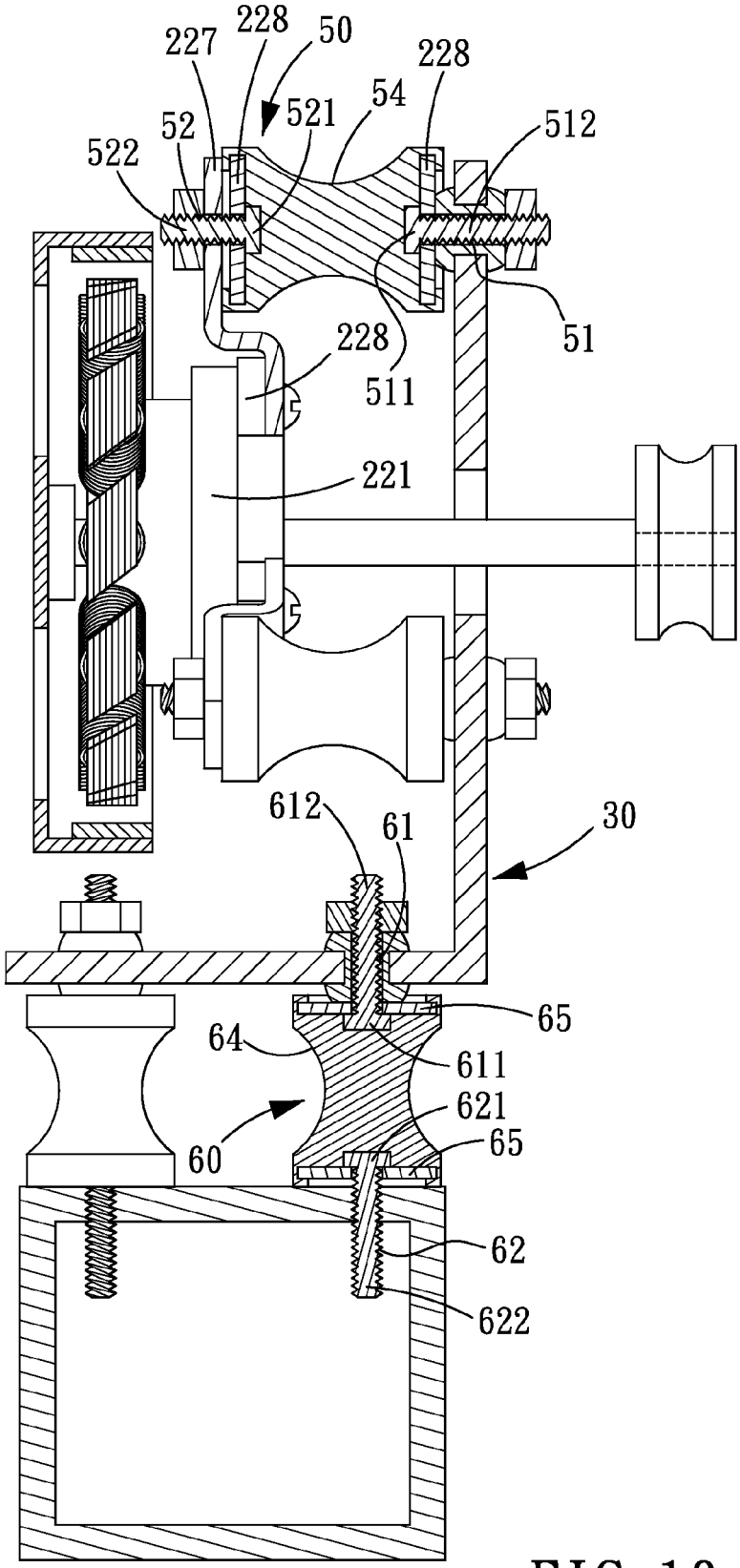
FIG. 10 is a cross-sectional view illustrating that the second elastic members in accordance with the present invention are each formed with the concave portion.
Figure 11:
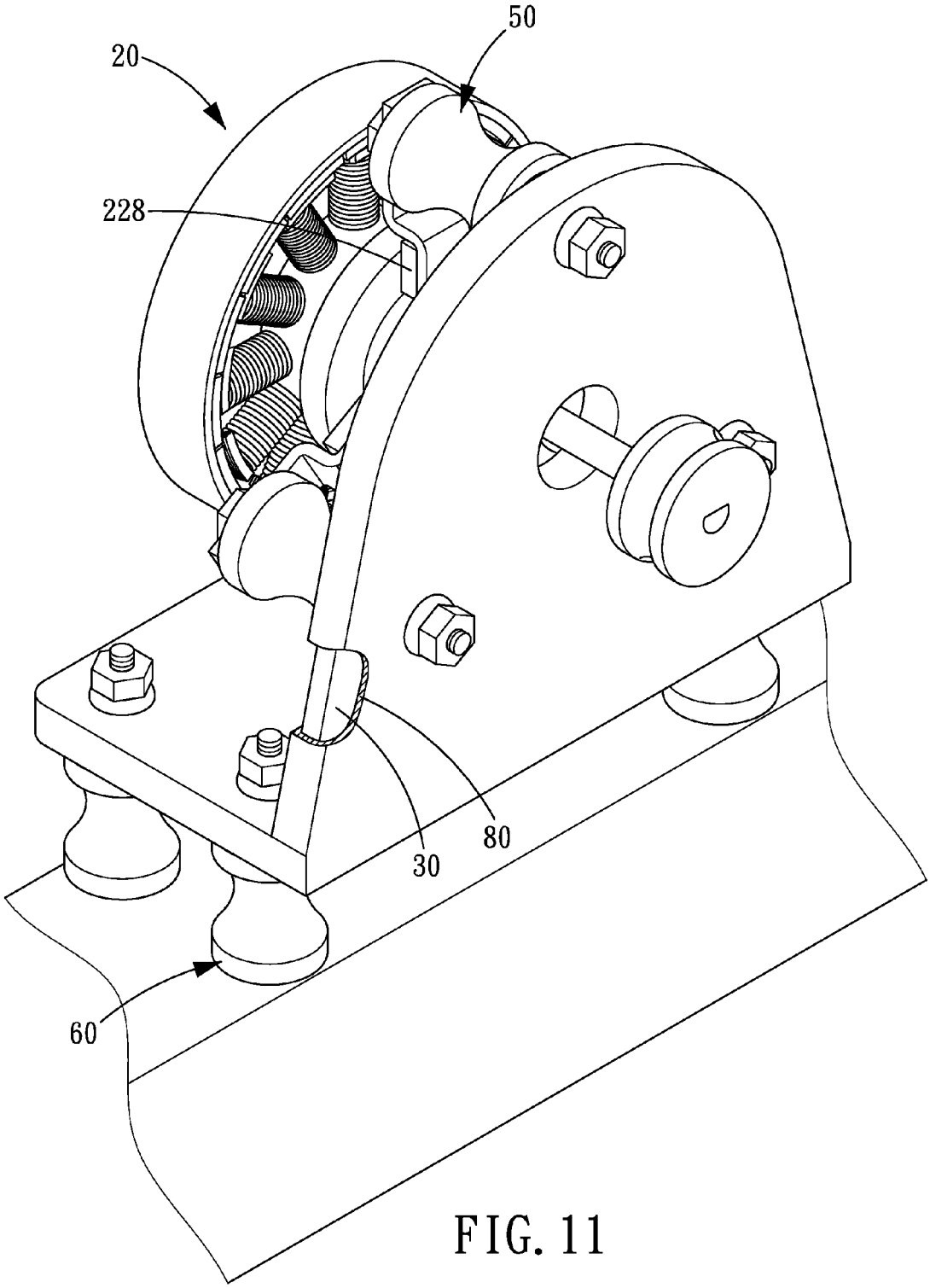
FIG. 11 is a perspective view illustrating that the concave portions of the second elastic members and the elastic rubber covering covered on the bracket in accordance with the present invention.

Referring to FIGS. 8-10, in the shock-absorbing device for an exercycle dynamo in accordance with the present invention, the respective second elastic members 50 can be defined with a radial concave portion 54 in the middle portion thereof, and provided with a stop ring 55 in each of two opposite ends thereof. The outer diameter of the head portions 511, 521 of the screws 51, 52 at both ends of the respective second elastic members 50 is bigger than that of the body portions 512, 522 of the screws 51, 52 at both ends of the respective second elastic members 50. The body portions 512, 522 of the respective screws 51, 52 penetrate the corresponding stop rings 55 and extend out of the respective corresponding second elastic members 50. The head portions 511, 521 of the respective screws 51, 52 are positioned against the corresponding stop rings 55 and located in the respective second elastic members 50. Between the respective mounting plates 227 and the magnet holder 221 is provided an elastic pad 228. The respective third elastic members 60 are defined with a radial concave portion 64 in the middle portion thereof, and provided a stop ring 65 in each of two opposite ends thereof. The outer diameter of the head portions 611, 621 of the screws 61, 62 at both ends of the respective third elastic members 60 is bigger than that of the body portions 612, 622 of the screws 61, 62 at both ends of the respective third elastic members 60. The body portions 612, 622 of the respective screws 61, 62 penetrate the corresponding stop rings 65 and extend out of the respective corresponding third elastic members 60. The head portions 611, 621 of the respective screws 61, 62 are positioned against the corresponding stop rings 65 and located in the respective third elastic members 60. By such arrangements, the elastic pads 228 between the mounting plates 227 and the magnet holder 221 can enhance the shock-absorbing and buffering effect, moreover, the radial concave portions 54 of the second elastic members 50 and the radial concave portions 64 of the third elastic members 60 can increase deformation capacity so as to enhance the shock-absorbing and buffering functions of the second elastic members 50 and the third elastic members 60. As shown in FIG. 11, the bracket 30 can also be covered with a layer of elastic rubber covering 80 to further enhance the shock-absorbing and buffering effect.

While we have shown and described various embodiments in accordance with the present invention, it is clear to those skilled in the art that further embodiments may be made without departing from the scope of the present invention.

What is claimed is:

1. A shock-absorbing device for an exercycle dynamo, wherein the exercycle comprises a base frame, a driving wheel rotatably disposed on the base frame, a dynamo disposed on the base frame and including a rotor and a stator, and a belt straddling on the driving wheel and the rotor, the shock-absorbing device comprises:

a bracket includes a base plate integral with a side plate, the base plate and the side plate are respectively defined with plural mounting holes;

plural first elastic members each are defined with an axial through hole, each of two opposite ends of the respective first elastic members extends to form a radial stop flange, the first elastic members are accommodated in the respective mounting holes of the base plate and the side plate of the bracket and the two stop flanges of each of the first elastic members abut against hole edges at both ends of the respective mounting holes;

plural second elastic members each are provided with a screw at each of two opposite ends thereof, each of the two screws of the respective second elastic members has a head portion disposed in the respective second elastic members and a body portion extended out of the respective second elastic members, the body portion of one of the two screws of the respective second elastic members is inserted through the through hole of the respective first elastic members disposed on the side plate and screwed with a nut, the body portion of the other of the two screw of the respective second elastic members is fixed to the stator of the dynamo; and plural positioning members each have one end inserted through the through hole of the respective first elastic members disposed on the base plate and screwed with a nut, and the other end fixed on the base frame.

2. The shock-absorbing device for an exercycle dynamo as claimed in claim 1, wherein the respective positioning members are a third elastic member, each of the third elastic members is provided with a screw at each of two opposite ends thereof, each of the two screws of the respective third elastic members has a head portion disposed in the respective third elastic members and a body portion extended out of the respective third elastic members, the body portion of one of the two screws of the respective third elastic members is inserted through the through hole of the respective first elastic members disposed on the base plate and screwed with the nut, the body portion of the other of the two screw of the respective third elastic members is screwed to the base frame.

3. The shock-absorbing device for an exercycle dynamo as claimed in claim 2, wherein each of the second elastic members and the third elastic members is in the form of a cylinder and formed with a radial concave portion in a middle portion thereof.

4. The shock-absorbing device for an exercycle dynamo as claimed in claim 3, wherein each of the second elastic members and the third elastic members is provided with a stop ring in each of two opposite ends thereof, an outer diameter of the head portion of the respective screws is bigger than that of the body portion of the respective screws, the body portion of the respective screws penetrate the corresponding stop rings and extend out of the respective second elastic members and the respective third elastic members, the head portions of the respective screws are positioned against the corresponding stop rings and located in the respective second elastic members and the respective third elastic members.

5. The shock-absorbing device for an exercycle dynamo as claimed in claim 2, wherein the bracket is covered with a layer of an elastic rubber covering.

6. The shock-absorbing device for an exercycle dynamo as claimed in claim 3, wherein the bracket is covered with a layer of an elastic rubber covering.

7. The shock-absorbing device for an exercycle dynamo as claimed in claim 1, wherein the stator of the dynamo includes a magnet holder which is defined with a center axle hole and provided with a plurality of radial magnetic poles, an elastic cushion and an axle bearing are arranged in each of two ends of the axle hole of the magnet holder, the respective elastic cushions are located between the magnet holder and the respective bearings, a plurality of windings is wound on the respective magnetic poles and shows a rhombic end-face profile, one side of the magnet holder of the stator is screwed with a plurality of mounting plates by means of screws, the screw in one end of the respective second elastic members is screwed with the respective mounting plates, the rotor includes a wheel having a wheel axle, and a plurality of magnets, the wheel axle is inserted through the two bearings and the axle hole of the magnet holder of the stator, the magnets are arranged opposite to the magnetic poles of the stator.

8. The shock-absorbing device for an exercycle dynamo as claimed in claim 7, wherein an elastic pad is provided between the respective mounting plates and the magnet holder of the stator.

9. The shock-absorbing device for an exercycle dynamo as claimed in claim 7, wherein the respective magnetic poles of the stator have a rhombic end face.

10. The shock-absorbing device for an exercycle dynamo as claimed in claim 7, wherein the wheel of the rotor of the dynamo is defined in one side thereof with a plurality of air holes.

* * * * *